US005863100A

United States Patent [19]

Martin

[11] Patent Number: 5,863,100

[45] Date of Patent: Jan. 26, 1999

[54] PNEUMATIC ROOFING MATERIAL REMOVING APPARATUS

[76] Inventor: Jeremy Michael Martin, 2404 Mason School Rd., Oakland, Md. 21550

[21] Appl. No.: 825,751

[22] Filed: Apr. 3, 1997

[51] Int. Cl.[6] ..... E04D 15/02

[52] U.S. Cl. ..... 299/37.1; 81/45; 30/170

[58] Field of Search ..... 299/37.1, 37.4; 30/169, 170; 15/93.1; 81/45

[56] References Cited

U.S. PATENT DOCUMENTS

| | | | |
|---|---|---|---|
| 1,535,411 | 4/1925 | Hansen | 299/37.4 X |
| 2,326,514 | 8/1943 | Bard | 299/37.4 |
| 2,465,192 | 3/1949 | Booth | 299/37.4 |
| 4,691,439 | 9/1987 | Marra | 30/170 |
| 4,699,430 | 10/1987 | Nichols | 30/170 X |
| 4,858,503 | 8/1989 | Dike, Jr. | 81/45 |
| 5,741,047 | 4/1998 | Ordonez | 299/37.1 |

*Primary Examiner*—David J. Bagnell

[57] ABSTRACT

A pneumatic roofing material removing apparatus including a housing having a pair of rear wheels disposed thereon. A pneumatic motor is disposed within the housing. The pneumatic motor has a rear portion extending outwardly of the housing. The rear portion has an air hose extending outwardly therefrom. A front portion of the pneumatic motor has an actuating arm extending outwardly therefrom. A planar cutting blade is disposed within the housing and secured to a free end of the actuating arm of the pneumatic motor. An arcuate shovel is secured to the housing over the cutting blade. A handle assembly is coupled with the housing. An operation mechanism is disposed within the handle assembly. The operation mechanism is coupled with the air hose of the pneumatic motor. The operation mechanism includes an exterior hose extending outwardly therefrom for coupling with an air compressor. The operation mechanism includes an activation trigger extending outwardly of the handle assembly.

11 Claims, 4 Drawing Sheets

PNEUMATIC ROOFING MATERIAL REMOVING APPARATUS

BACKGROUND OF THE INVENTION

1. Field of the Invention

The present invention relates to a pneumatic roofing material removing apparatus and more particularly pertains to removing shingles, rolled roofing and old flooring materials with a pneumatic roofing material removing apparatus.

2. Description of the Prior Art

The use of roof material removers is known in the prior art. More specifically, roof material removers heretofore devised and utilized for the purpose of removing roofing materials are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,277,104 to Sanchez discloses a reciprocating shingle remover with upward thrust blade.

U.S. Pat. No. 4,673,219 to Perciful discloses a power driven roofing removal tool.

U.S. Pat. No. 4,691,439 to Marra discloses a powered roof shingle detacher and stripper apparatus.

U.S. Pat. No. 4,699,430 to Nichols discloses a material stripping apparatus.

U.S. Pat. No. 4,880,491 to Jacobs et al. discloses a guided roofing materials removal apparatus.

U.S. Pat. No. 4,269,450 to Welborn discloses an asphalt shingle remover and deroofer apparatus.

While these devices fulfill their respective, particular objective and requirements, the aforementioned patents do not describe a pneumatic roofing material removing apparatus for removing shingles, rolled roofing and old flooring materials.

In this respect, the pneumatic roofing material removing apparatus according to the present invention substantially departs from the conventional concepts and designs of the prior art, and in doing so provides an apparatus primarily developed for the purpose of removing shingles, rolled roofing and old flooring materials.

Therefore, it can be appreciated that there exists a continuing need for new and improved pneumatic roofing material removing apparatus which can be used for removing shingles, rolled roofing and old flooring materials. In this regard, the present invention substantially fulfills this need.

SUMMARY OF THE INVENTION

In the view of the foregoing disadvantages inherent in the known types of roof material removers now present in the prior art, the present invention provides an improved pneumatic roofing material removing apparatus. As such, the general purpose of the present invention, which will be described subsequently in greater detail, is to provide a new and improved pneumatic roofing material removing apparatus and method which has all the advantages of the prior art and none of the disadvantages.

To attain this, the present invention essentially comprises a housing having a top end, an arcuate bottom end, an enlarged open front end, an open rear end and opposed sides together defining a hollow interior. The top end has an upwardly extending portion at a back portion thereof. The opposed sides each have a wheel disposed thereon inwardly of the open rear end of the housing. Each of the wheels have a locking assembly associated therewith. A pneumatic motor is disposed within the hollow interior of the housing. The pneumatic motor has a rear a portion extending outwardly of the open rear end of the housing. The rear portion has an air hose extending outwardly therefrom. A front portion of the pneumatic motor has an actuating arm extending outwardly therefrom. A planar cutting blade is disposed within the hollow interior of the housing. The cutting blade has an interior end and an exterior end. The interior end is hingedly secured to a free end of the actuating arm of the pneumatic motor. The exterior end extends outwardly of the enlarged open front end of the housing. The exterior end has a cutting edge disposed thereon. An arcuate shovel is secured to the enlarged open front end of the housing. The shovel has an upper end and a lower end. The lower end is disposed over the exterior end of the cutting blade. The upper end is disposed over the enlarged open front end of the housing. A handle assembly includes an elongated first handle having a lower end pivotally and adjustably coupled with the upwardly extending portion of the housing. The first handle has an aperture through a central portion thereof. The handle assembly further includes an intermediate second handle selectively positionable within the aperture through the first handle. Free ends of both the first handle and second handle have a handgrip disposed thereon. An operation mechanism is disposed within the free end of the first handle of the handle assembly. The operation mechanism is coupled with the air hose of the pneumatic motor. The operation mechanism includes an exterior hose extending outwardly therefrom for coupling with an air compressor. The operation mechanism includes an activation trigger extending outwardly of the first handle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pneumatic roofing material removing apparatus which has all the advantages of the prior art roof material removers and none of the disadvantages.

It is another object of the present invention to provide a new and improved pneumatic roofing material removing apparatus which may be easily and efficiently manufactured and marketed.

It is a further object of the present invention to provide a new and improved pneumatic roofing material removing apparatus which is of durable and reliable construction.

An even further object of the present invention is to provide a new and improved pneumatic roofing material removing apparatus which is susceptible of a low cost of manufacture with regard to both materials and labor, and which accordingly is then susceptible of low prices of sale to the consuming public, thereby making such a pneumatic roofing material removing apparatus economically available to the buying public.

Even still another object of the present invention is to provide a new and improved pneumatic roofing material removing apparatus for removing shingles, rolled roofing and old flooring materials.

Lastly, it is an object of the present invention to provide a new and improved pneumatic roofing material removing apparatus including a housing having a pair of rear wheels disposed thereon. A pneumatic motor is disposed within the housing. The pneumatic motor has a rear portion extending outwardly of the housing. The rear portion has an air hose extending outwardly therefrom. A front portion of the pneumatic motor has an actuating arm extending outwardly therefrom. A planar cutting blade is disposed within the housing and secured to a free end of the actuating arm of the pneumatic motor. An arcuate shovel is secured to the housing over the cutting blade. A handle assembly is coupled with the housing. An operation mechanism is disposed within the handle assembly. The operation mechanism is coupled with the air hose of the pneumatic motor. The operation mechanism includes an exterior hose extending outwardly therefrom for coupling with an air compressor. The operation mechanism includes an activation trigger extending outwardly of the handle assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
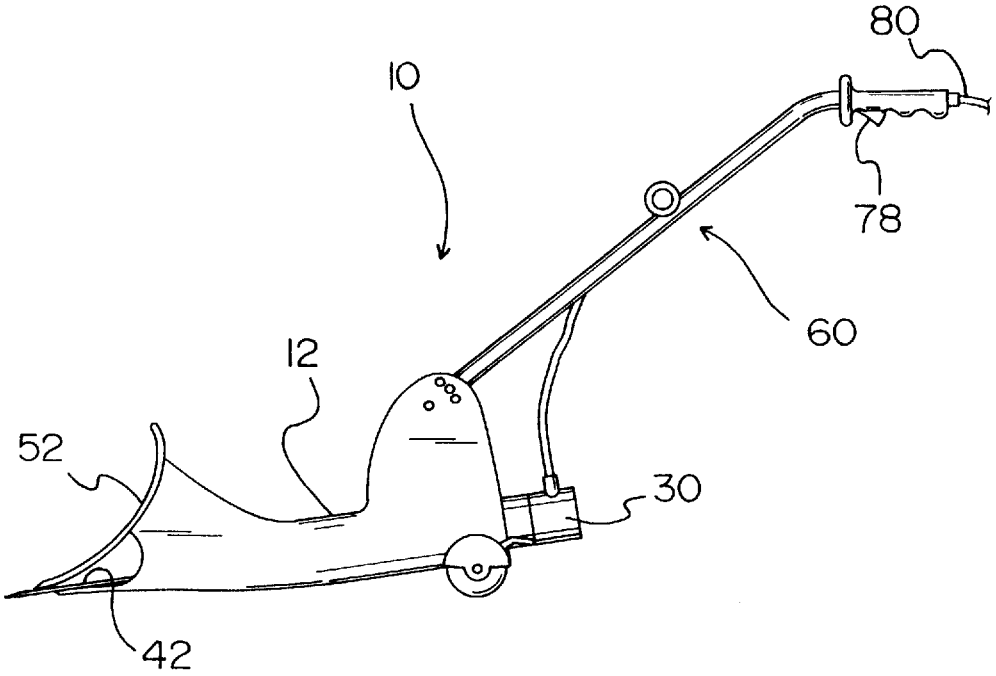
FIG. 1 is a side view of the preferred embodiment of the pneumatic roofing material removing apparatus constructed in accordance with the principles of the present invention.

With reference now to the drawings, and in particular, to FIGS. 1 through 8 thereof, the preferred embodiment of the new and improved pneumatic roofing material removing apparatus embodying the principles and concepts of the present invention and generally designated by the reference number 10 will be described.

Specifically, it will be noted in the various Figures that the device relates to a pneumatic roofing material removing apparatus for removing shingles, rolled roofing and old flooring materials. In its broadest context, the device consists of a housing, a pneumatic motor, a planar cutting blade, an arcuate shovel, a handle assembly and an operation mechanism. Such components are individually configured and correlated with respect to each other so as to attain the desired objective.

The apparatus 10 includes a housing 12 having a top end 14, an arcuate bottom end 16, an enlarged open front end 18, an open rear end 20 and opposed sides 22 together defining a hollow interior. The top end 14 has an upwardly extending portion 24 at a back portion thereof. The opposed sides 22 each have a wheel 26 disposed thereon inwardly of the open rear end 20 of the housing 12. Each of the wheels 26 have a locking assembly 28 associated therewith. The locking assembly 28 is comprised of a lever type foot brake whereby a user's foot pressure will enable contact with the wheels 26 thereby preventing movement of the apparatus. The levers can be easily lifted to allow for the movement of the apparatus 10 to continue. The arcuate bottom end 16 curves upwardly towards the enlarged open front end 18 to form a skid plate.

A pneumatic motor 30 is disposed within the hollow interior of the housing 12. The pneumatic motor 30 has a rear portion 32 extending outwardly of the open rear end 20 of the housing 12. The rear portion 32 has an air hose 34 extending outwardly therefrom. A front portion 36 of the pneumatic motor 30 has an actuating arm 38 extending outwardly therefrom. The pneumatic arm 30 serves to move the actuating arm 38 in a back and forth motion.

Figure 2:
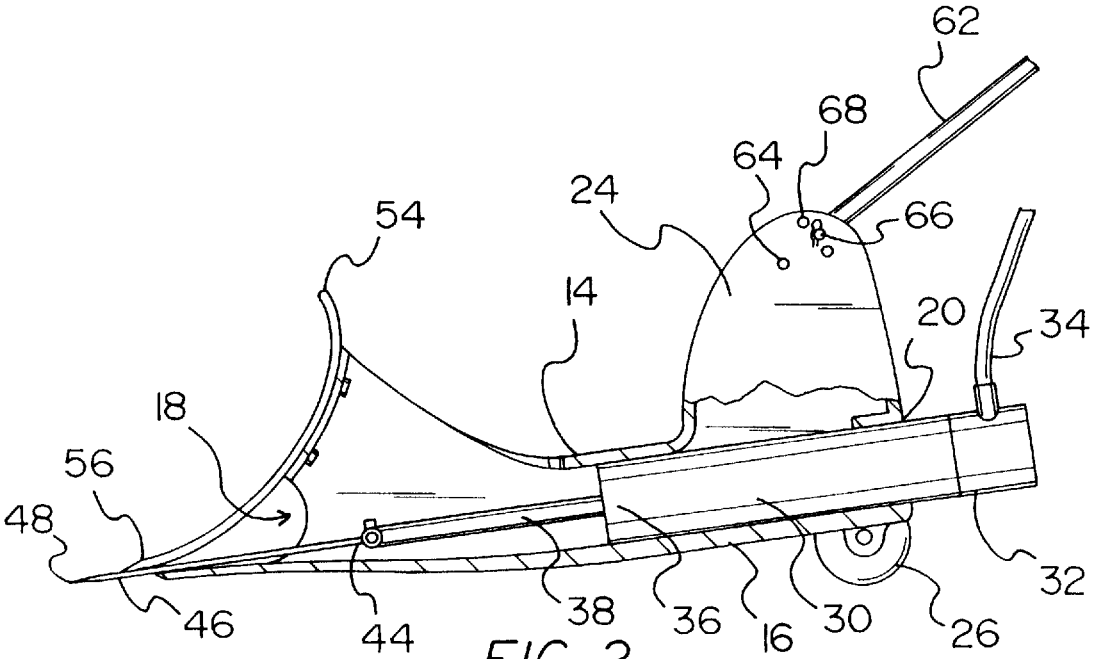
FIG. 2 is a side elevation view of the present invention shown in cross-section.
Figure 3:
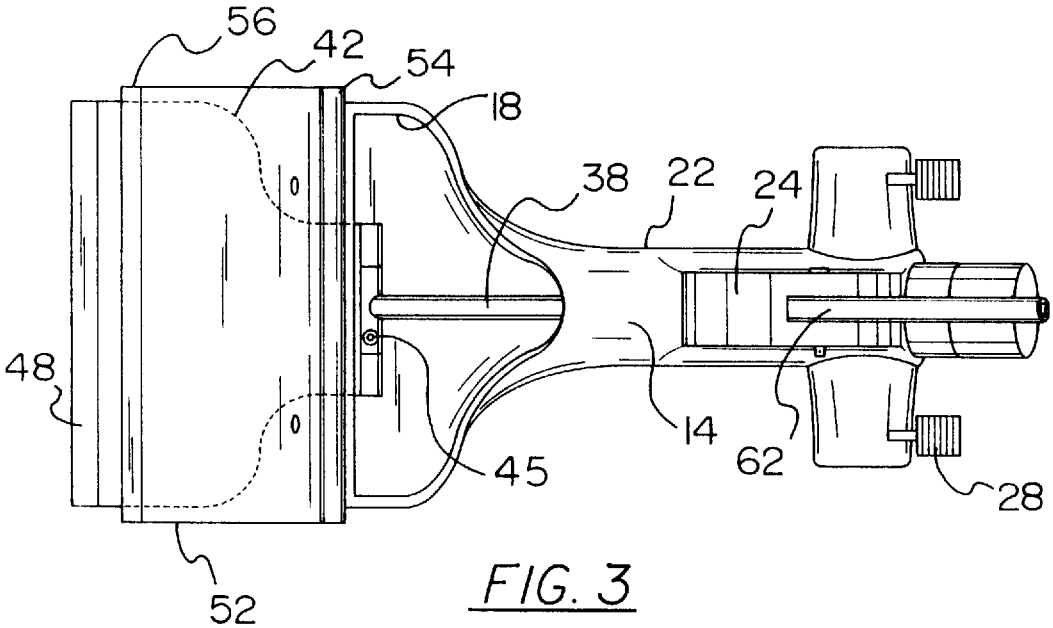
FIG. 3 is a top plan view of the preferred embodiment of the present invention.
Figure 4:
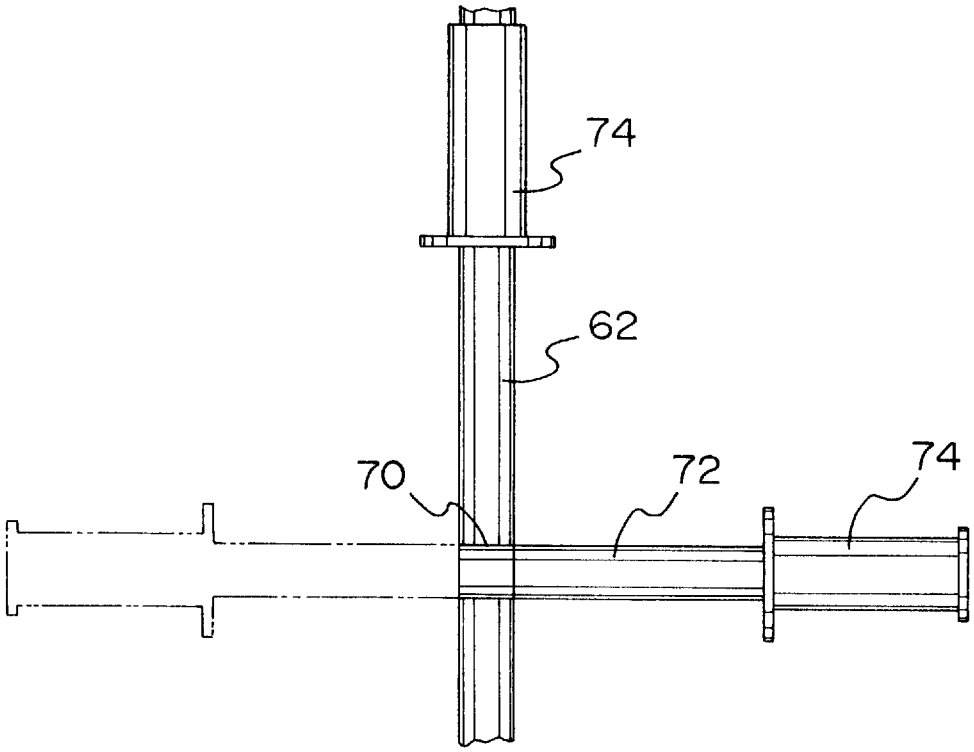
FIG. 4 is a front view of the adjustable intermediate handle of the present invention.
Figure 5:
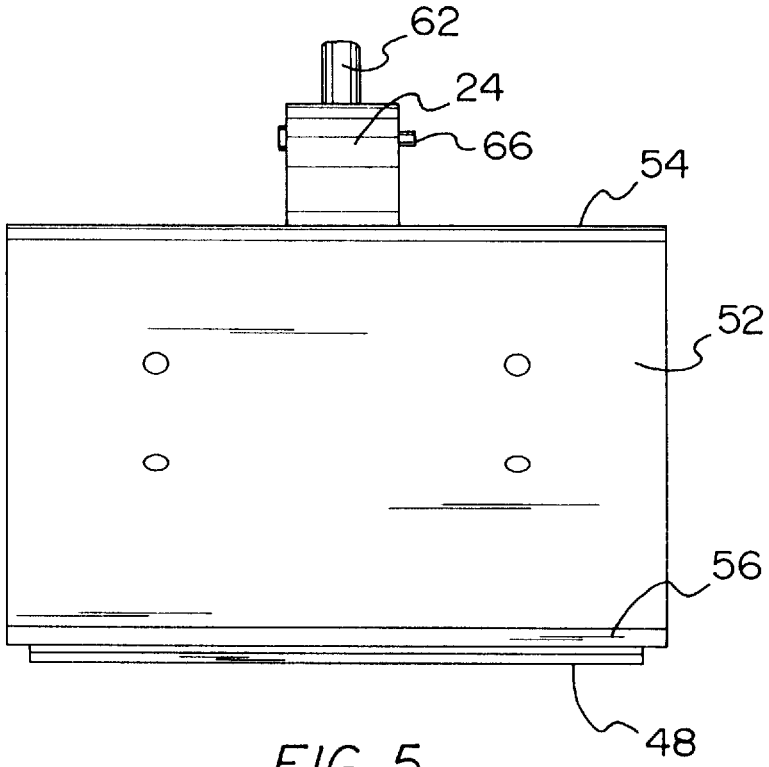
FIG. 5 is a front elevation view of the present invention.
Figure 6:
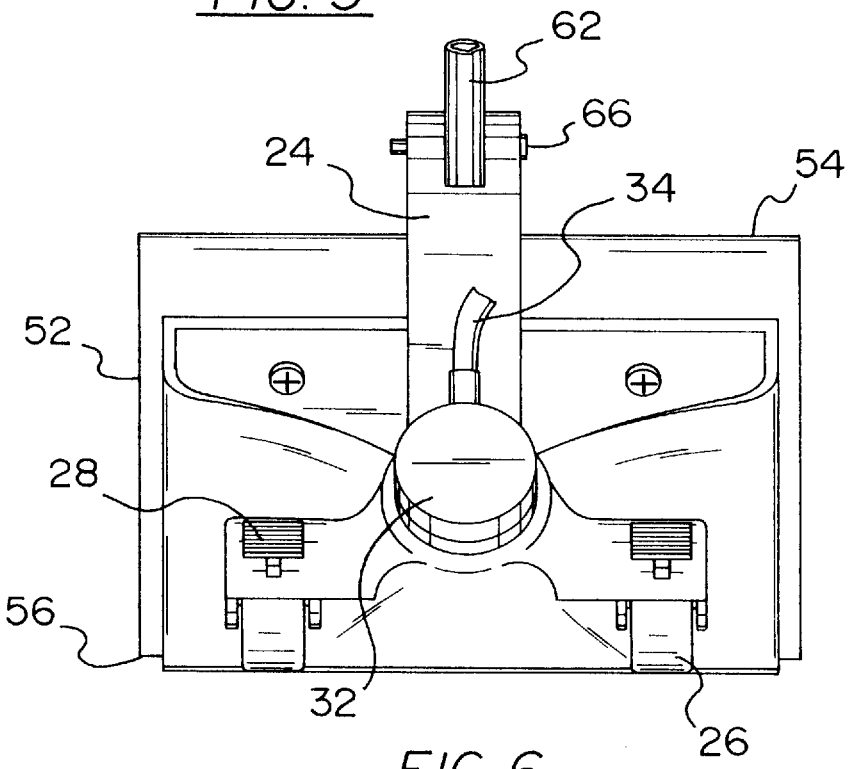
FIG. 6 is a rear elevation view of the present invention.
Figure 7:
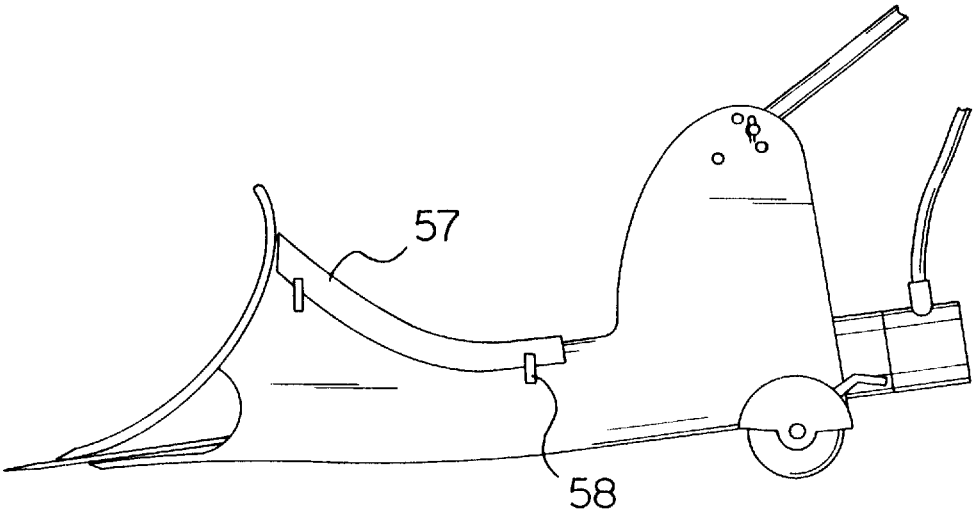
FIG. 7 is a side elevation view of the present invention with a cover positioned thereon.
Figure 8:
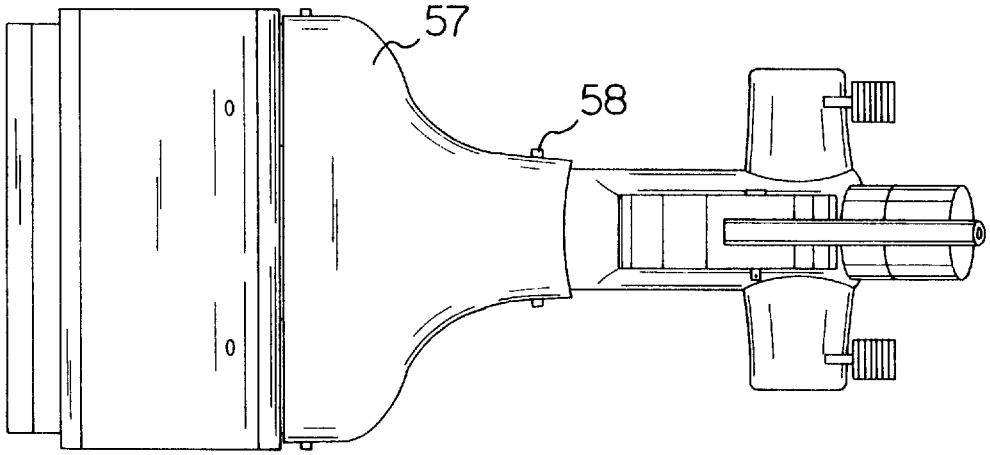
FIG. 8 is a top plan view of the present invention as illustrated in FIG. 7.

Next, a planar cutting blade 42 is disposed within the hollow interior of the housing 12. The cutting blade 42 has an interior end 44 and an exterior end 46. The interior end 44 is hingedly secured to a free end of the actuating arm 38 of the pneumatic motor 30. The free end of the actuating arm has a grease opening 45 therein to allow for the addition of oil or grease to facilitate rotation of the cutting blade with respect to the actuating arm. The exterior end 46 extends outwardly of the enlarged open front end 18 of the housing 12. The exterior end 46 has a cutting edge 48 disposed thereon. The exterior end 46 rests upon the arcuate bottom end 16 or skid plate of the housing as best seen in FIG. 2. The actuating arm 38 will serve to work the cutting blade 42 in a striking principle, hitting under shingles or roofing material in a short back-and-forth motion. The cutting blade 42 can also be removed from the apparatus for sharpening or replacement.

An arcuate shovel 52 is secured to the enlarged open front end 18 of the housing 12. The shovel 52 has an upper end 54 and a lower end 56. The lower end 56 is disposed over the exterior end 46 of the cutting blade 42. The upper end 54 is disposed over the enlarged open front end 18 of the housing 12. The arcuate shovel 52 is curved in such a way as to roll the old roofing material forward as it is being dislodged by the cutting blade 42, then off to the side of the apparatus 10.

The apparatus 10 includes a cover 57 removably coupled with and over the enlarged open front end of the housing. The cover 57 has a plurality of pliable clips 58 to allow for removal thereof from the housing. The cover 57 as protection for the actuation arm 38. Note FIGS. 7 and 8.

A handle assembly 60 includes an elongated first handle 62 having a lower end pivotally and adjustably coupled with the upwardly extending portion 24 of the housing 12. The lower end of the first handle 62 is pivotally secured to the housing by a fixed pin 64. A removable pin, 66 is selectively placed in one of a series of apertures 68 in the upwardly extending portion 24 to vary the angle of the first handle 62 with respect to the housing 12. The first handle 62 has an aperture 70 through a central portion thereof. The handle assembly 60 further includes an intermediate second handle 72 selectively positionable within the aperture 70 through the first handle 62. The user can select which side of the first handle 62 to place the intermediate second handle 72. This selection will usually depend on the hand dominance of the user. Free ends of both the first handle 62 and second handle 72 have a handgrip 74 disposed thereon.

Lastly, an operation mechanism 78 is disposed within the free end of the first handle 62 of the handle assembly 60. The operation mechanism 78 is coupled with the air hose 34 of the pneumatic motor 30. The operation mechanism 78 includes an exterior hose 80 extending outwardly therefrom for coupling with an air compressor (not shown). The operation mechanism 78 includes an activation trigger extending outwardly of the first handle 62. The user simply presses on the trigger to allow the air pressure to the pneumatic motor 30 which will activation the actuation arm 38 thereby operating the cutting blade 42.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A pneumatic roofing material removing apparatus for removing shingles, rolled roofing and old flooring materials comprising, in combination:

a housing having a top end, an arcuate bottom end, an enlarged open front end, an open rear end and opposed sides together defining a hollow interior, the top end having an upwardly extending portion at a back portion thereof, the opposed sides each having a wheel disposed thereon inwardly of the open rear end of the housing, each of the wheels having a locking assembly associated therewith;

a pneumatic motor disposed within the hollow interior of the housing, the pneumatic motor having a rear portion extending outwardly of the open rear end of the housing, the rear portion having an air hose extending outwardly therefrom, a front portion of the pneumatic motor having an actuating arm extending outwardly therefrom;

a planar cutting blade disposed within the hollow interior of the housing, the cutting blade having an interior end and an exterior end, the interior end hingedly secured to a free end of the actuating arm of the pneumatic motor, the exterior end extending outwardly of the enlarged open front end of the housing, the exterior end having a cutting edge disposed thereon;

an arcuate shovel secured to the enlarged open front end of the housing, the shovel having an upper end and a lower end, the lower end disposed over the exterior end of the cutting blade, the upper end disposed over the enlarged open front end of the housing;

a cover removably coupled with and over the enlarged open front end of the housing, the cover having a plurality of pliable clips to allow for removal thereof from the housing;

a handle assembly including an elongated first handle having a lower end pivotally and adjustably coupled with the upwardly extending portion of the housing, the first handle having an aperture through a central portion thereof, the handle assembly further including an intermediate second handle selectively positionable within the aperture through the first handle, free ends of both the first handle and second handle having a handgrip disposed thereon; and an operation mechanism disposed within the free end of the first handle of the handle assembly, the operation mechanism coupled with the air hose of the pneumatic motor, the operation mechanism including an exterior hose extending outwardly therefrom for coupling with an air compressor, the operation mechanism including an activation trigger extending outwardly of the first handle.

2. A pneumatic roofing material removing apparatus comprising:

a housing having a pair of rear wheels disposed thereon, the housing having a top end, an arcuate bottom end, an enlarged open front end, an open rear end and opposed sides together defining a hollow interior;

a pneumatic motor disposed within the housing, the pneumatic motor having a rear portion extending outwardly of the housing, the rear portion having an air hose extending outwardly therefrom, a front portion of the pneumatic motor having an actuating arm extending outwardly therefrom;

a planar cutting blade disposed within the housing and secured to a free end of the actuating arm of the pneumatic motor;

an arcuate shovel secured to the housing over the cutting blade;

a handle assembly coupled with the housing; and an operation mechanism disposed within the handle assembly, the operation mechanism coupled with the air hose of the pneumatic motor, the operation mechanism including an exterior hose extending outwardly therefrom for coupling with an air compressor, the operation mechanism including an activation trigger extending outwardly of the handle assembly.

3. The apparatus as set forth in claim 2 wherein each of the wheels having a locking assembly associated therewith.

4. The apparatus as set forth in claim 2 wherein the top end of the housing having an upwardly extending portion at a back portion thereof for coupling with the handle assembly, the opposed sides each having the wheels disposed thereon inwardly of the open rear end of the housing.

5. The apparatus as set forth in claim 4 wherein the handle assembly including an elongated first handle having a lower end pivotally and adjustably coupled with the upwardly extending portion of the housing, the first handle having an aperture through a central portion thereof.

6. The apparatus as set forth in claim 5 wherein the handle assembly further including an intermediate second handle selectively positionable within the aperture through the first handle, free ends of both the first handle and second handle having a handgrip disposed thereon.

7. The apparatus as set forth in claim 6 wherein the operation mechanism is disposed within the free end of the first handle of the handle assembly, the operation mechanism including the activation trigger extending outwardly of the first handle.

8. The apparatus as set forth in claim 4 and further including a cover removably coupled with and over the enlarged open front end of the housing.

9. The apparatus as set forth in claim 8 wherein the cover having a plurality of pliable clips to allow for removal thereof from the housing.

10. The apparatus as set forth in claim 2 wherein the cutting blade having an interior end and an exterior end, the interior end hingedly secured to the free end of the actuating arm of the pneumatic motor, the exterior end extending outwardly of the housing, the exterior end having a cutting edge disposed thereon.

11. The apparatus as set forth in claim 10 wherein the arcuate shovel having an upper end and a lower end, the lower end disposed over the exterior end of the cutting blade, the upper end disposed over the housing.

* * * * *